US005363784A

United States Patent [19]

Adamski, Jr. et al.

[11] Patent Number: 5,363,784

[45] Date of Patent: * Nov. 15, 1994

[54] SEWING CLOTH HANDLING DEVICE

[75] Inventors: Maximilian Adamski, Jr., Palatine; Paul A. Berg, Crystal Lake, both of Ill.

[73] Assignee: Union Special Corporation, Charlotte, N.C.

[ * ] Notice: The portion of the term of this patent subsequent to Mar. 30, 2010 has been disclaimed.

[21] Appl. No.: 37,306

[22] Filed: Mar. 26, 1993

Related U.S. Application Data

[63] Continuation of Ser. No. 783,275, Oct. 28, 1991, Pat. No. 5,197,722.

[51] Int. Cl.[5] ..... D05B 35/00

[52] U.S. Cl. ..... 112/121.12; 112/262.3; 112/147

[58] Field of Search ..... 112/121.12, 121.15, 112/141, 147, 304, 262.3, 262.2; 270/32, 45; 493/405, 418, 419, 450, 937

[56] References Cited

U.S. PATENT DOCUMENTS

| | | | |
|---|---|---|---|
| 2,861,801 | 11/1958 | Cran . | |
| 3,094,321 | 6/1963 | Kamberg . | |
| 3,260,518 | 7/1966 | Kamberg et al. . | |
| 3,554,354 | 1/1971 | Reid et al. . | |
| 3,824,964 | 7/1974 | Ryan . | |
| 3,874,043 | 4/1975 | Holm . | |
| 4,061,327 | 12/1977 | Blessing . | |
| 4,428,315 | 1/1984 | Keeton . | |
| 4,460,350 | 7/1984 | Mittal et al. . | |
| 4,526,115 | 7/1985 | Kosrow et al. . | |
| 4,528,922 | 7/1985 | Adamski et al. . | |
| 4,530,295 | 7/1985 | Adamski et al. . | |
| 4,531,721 | 7/1985 | Kosrow . | |
| 4,587,913 | 5/1986 | Yin et al. . | |
| 4,784,381 | 11/1988 | Prochut et al. . | |
| 4,796,552 | 1/1989 | Adamski, Jr. . | |
| 4,800,830 | 1/1989 | Adamski et al. . | |
| 4,819,926 | 4/1989 | Kosrow et al. . | |
| 4,825,785 | 5/1989 | Adamski, Jr. . | |
| 4,858,546 | 8/1989 | Adamski et al. . | |
| 4,896,619 | 1/1990 | Adamski et al. . | |
| 4,911,092 | 3/1990 | Adamski, Jr. et al. . | |
| 4,922,842 | 5/1990 | Adamski et al. . | |
| 4,928,610 | 5/1990 | Akutsu . | |
| 4,972,787 | 11/1990 | Adamski et al. . | |
| 5,108,017 | 4/1992 | Adamski, Jr. et al. . | |
| 5,152,235 | 10/1992 | Goto et al. | 112/304 X |
| 5,159,874 | 11/1992 | Adamski, Jr. et al. . | |
| 5,226,378 | 7/1993 | Suzuki et al. | 112/121.15 X |

FOREIGN PATENT DOCUMENTS

| | | |
|---|---|---|
| 0208754 | 8/1990 | European Pat. Off. . |
| 1610754 | 2/1971 | Germany . |
| 3347648A1 | 7/1984 | Germany . |
| 3617572A1 | 1/1987 | Germany . |
| 8700117U1 | 6/1987 | Germany . |
| 4128330A1 | 3/1992 | Germany . |

*Primary Examiner*—Clifford D. Crowder
*Assistant Examiner*—Paul C. Lewis
*Attorney, Agent, or Firm*—Willian Brinks Hofer Gilson & Lione

[57] ABSTRACT

A device for picking up, turning over, folding and aligning a sleeve cloth that is continuously carried by a moving conveyer. The device comprises a jaw located above the upper surface of the moving conveyer and a lifting blade located below the bottom surface of a moving conveyer. The leading edge of the sleeve cloth is detected by a sensor that triggers the lifting blade to push a front portion of the cloth up and into the jaw which holds the cloth as the conveyer continues to move. The cloth is folded and aligned by the action of the conveyor belt and a first blower, which blows air on a top side of the cloth, and a second blower, which blows air on a bottom side of the cloth.

18 Claims, 4 Drawing Sheets

SLEEVE PICK UP + DROP OFF TIMINGS

SEWING CLOTH HANDLING DEVICE

This is a continuation of pending application Ser. No. 07/783,275, filed Oct. 28, 1991, now U.S. Pat. No. 5,197,722.

BACKGROUND OF THE INVENTION

The present invention relates to a device for handling blank pieces of sewing cloth such as pre-cut sleeve cloth. In particular, the present invention relates to a device for picking up, turning over, folding and aligning sleeve cloth so the cloth may be processed in further sewing operations.

In the manufacture of a shirt, blank sleeve cloth is generally first trimmed, folded and hemmed before further sewing operations are performed. Trimming, folding and hemming machines often require the top side of the sleeve to be facing up to perform the respective operations, while further sewing operations require the sleeve to be folded inside out. To prepare for a further seaming operation, an operator would have to take the hemmed sleeve and manually fold it in half with the cloth inside out and simultaneously align the hemmed edges. Thus, a device which could automatically turn the sleeve inside out, and fold the sleeve and align the hemmed edges would save time and expense, and increase operator efficiency.

SUMMARY OF THE INVENTION

The present invention provides a device for handling sewing cloth on a conveyor comprising a cloth holding means, such as a jaw, located above a conveyor belt, and a cloth lifting means, such as a blade, located below a conveyor belt. A sensor and a front air blower are located before the cloth holding means in the line of feed of the conveyor belt. A rear air blower is located after the cloth holding means in the line of feed.

In another embodiment, the present invention provides a method for handling sewing cloth wherein a conveyor belt carries a sewing cloth and the leading edge of the sewing cloth is sensed by a sensor. The sensor triggers a lifting apparatus which lifts the front portion of the sewing cloth from the bottom up and into a jaw. The jaw holds the front portion of the sewing cloth stationary and a front air blower is turned on. The sewing cloth is folded in half and turned over as the conveyor belt continues to carry the remainder of the cloth underneath the jaw and the front air blower blows air in the direction of the jaw. As the trailing edge of the sewing cloth passes the sensor, the sensor triggers a rear air blower to blow air in the direction of the jaw. The jaw opens to release the front portion of the sewing cloth and the rear blower aligns the cloth and completes the fold.

In another embodiment, the present invention provides a sewing cloth handling device comprising a conveyor means for the cloth, a means for picking up a front portion of the cloth, and a means for folding the cloth in half and aligning the cloth, said folding and aligning means including a blowing means.

DETAILED DESCRIPTION OF THE DRAWINGS AND PREFERRED EMBODIMENTS

Figure 1:
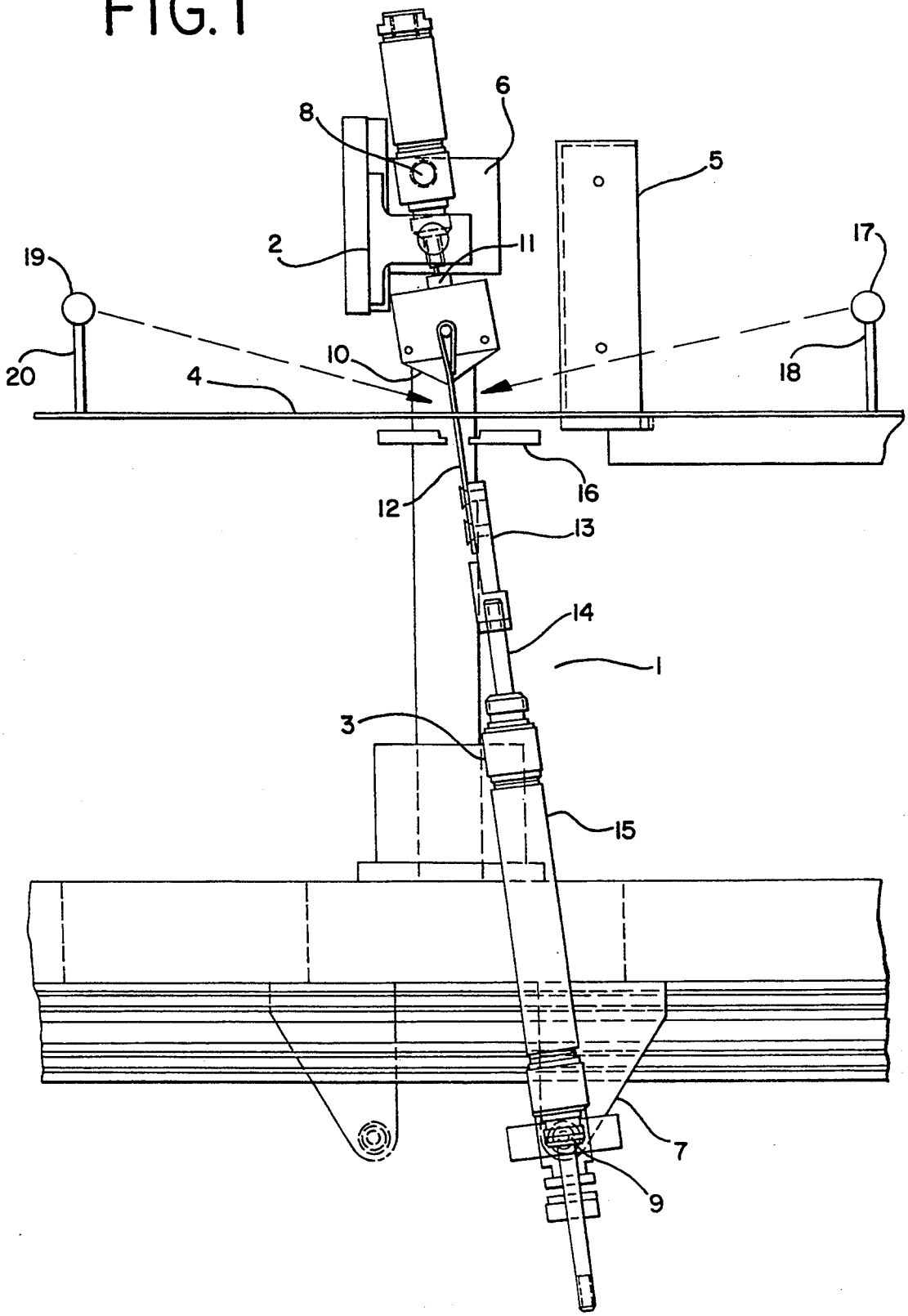
FIG. 1 illustrates a side view of one embodiment of a sleeve handling device.
Figure 2A:
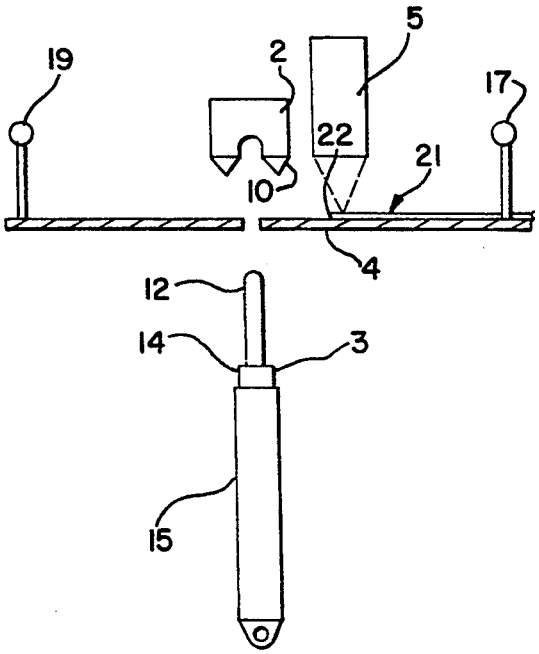
FIGS. 2A through 2D are block diagrams sequentially illustrating the sleeve handling device of FIG. 1 in operation.
Figure 2B:
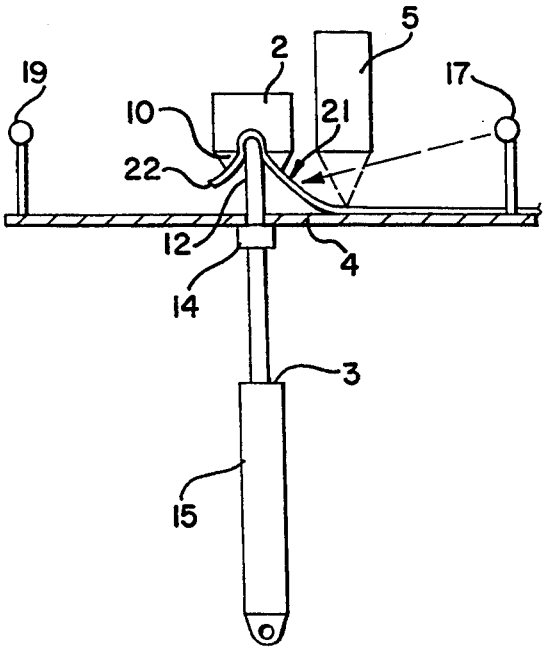
Figure 2C:
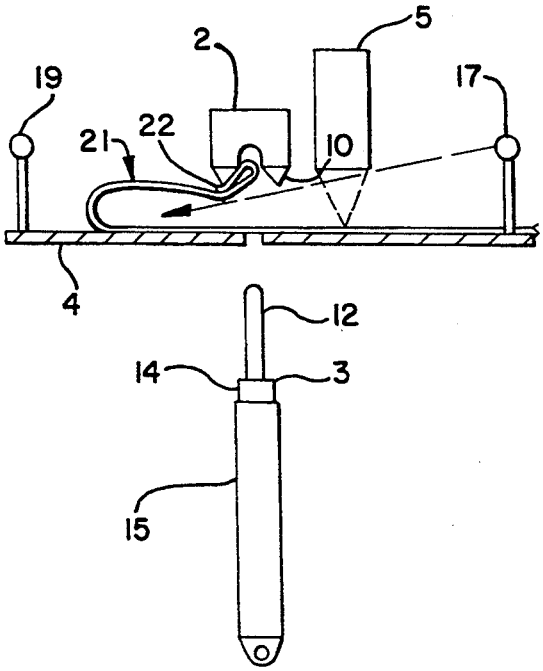
Figure 2D:
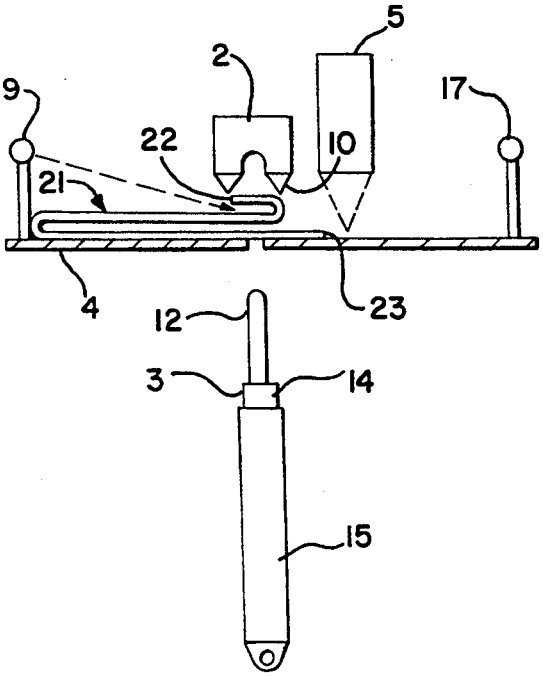

Referring to FIG. 1, the sleeve handling device 1 comprises a pick up Jaw assembly 2, positioned above, and a lifting assembly 3, positioned below a conveyor belt 4. Generally, a number of conveyor belts are used and are spatially arranged. A sensor 5 is positioned before the jaw assembly 2 in the line of feed for the conveyor belt 4. The sensor 5 is preferably a photosensitive sensor that transmits a first signal or no signal when a light beam is uninterrupted or uncovered and a second signal when a light beam is interrupted or covered.

The jaw assembly 2 and lifting assembly 3 are each pivotally attached to blocks 6, 7 by pins 8, 9, respectively. Each assembly is attached such that it can be locked either perpendicular or at an angle with respect to the conveyor belt 4. In FIG. 1, the jaw assembly 2 and lifting assembly 3 are shown at about a 15° angle.

The jaw assembly 2 contains a pair of jaws 10 pivotally attached to a housing 11. The jaw 10 may contain any number of opposable parts that open and close to hold the sewing cloth or ply. The jaw assembly may be actuated mechanically, electronically or a combination of both, and may be any type of construction or means for holding and releasing a piece of cloth, including a clamp or pincer. One such assembly that includes a jaw, and the operation of that assembly, are described in U.S. Pat. Nos. 4,819,926 and 4,784,381, whose teachings are incorporated herein.

The lifting assembly 3 contains a sleeve pick up blade 12 mounted to a base 13 that is attached to a rod 14. The sleeve pick up blade may comprise one or more elongated blades which in cooperation with the rod 14 function to push a piece of cloth toward the jaw assembly 2. The rod functions as a piston, and is attached within a housing 15 such that when the rod 14 reciprocates it carries the sleeve blade 12 towards and away from the jaw assembly 2. The lifting assembly may be constructed in any manner to achieve these functions, and one such assembly and its operation with a jaw assembly are described in U.S. Pat. Nos. 4,819,926 and 4,784,381. An adjustable block 16 functions as a support bed for the conveyor belt 4, and if necessary, assists to guide the sleeve blade 12 toward the jaw assembly.

While the present invention is described here in the context of a jaw assembly and lifting assembly, equivalent cloth pick up means and lifting means are contemplated. For example, a claw or pincer may be attached to an arm located above the conveyor. The arm and claw would be activated at the appropriate time and pick up the cloth. The pick up function could also be accomplished by pneumatic means located above the conveyor belt.

A forward air blower 17 is attached to a base 18 and functions as a means for separating plies. A rear air blower 19 is attached to a base 20 and functions as a means for uncurling the leading edge of a ply. Each of the blowers 17, 19 extend horizontally over the width of the conveyor belt 4 and contain one or more air Jet nozzles (not shown). As shown by the dotted lines in FIG. 1, the nozzles direct the air jets toward the area below the jaw assembly 2. The front and rear blowers 17, 19, the sensor 5, the Jaw assembly 2, the lifting assembly 3 and the motor that drives the conveyor belt 4 may be connected to a central processing unit which monitors the location of a piece of cloth on the conveyor belt 4 and transmits signals between each of the above parts and operations so that the piece of cloth is picked up, turned, aligned and folded at the appropriate time.

The block diagram in FIG. 2 illustrates the operation of the handling device shown in FIG. 1. The operation is illustrated in four Stages, A, B, C and D, where the line of feed (LOF) is from right to left. In Stage A the a sleeve cloth 21 is shown resting on a plurality of spaced apart conveyor belts 4 at a position where the leading edge 22 is detected by the sensor 5. When the leading edge 22 passes below the sensor 5 a signal is generated by the sensor 5 which signals a counter, such as a shaft encoder, to begin counting pulses.

The invention is not limited to pulse counting, and may comprise any means for monitoring the position of the cloth on the conveyor belt and controlling the lifting and folding operation. Such means may be mechanical, and may include digital motors and mechanical registration and encoder units, and may be computerized, and include central processing units which receive and transmit signals to actuate and stop the various operations and parts. Such means may also include a timer, a constant clock signal or a pulse counter, alone or in any combination.

In Stage B, the jaw 10 is in the open position. As the leading edge 22 of the sleeve 21 passes under the pick up jaw assembly 2, the lifting assembly 3 is actuated at a predetermined pulse count, causing sleeve blade 12 to lift upwards and push the front portion of the sleeve 21 into the open jaw 10 of the jaw assembly. When more than two conveyor belts are used, the blade 12 may contain a number of extensions which contact the sleeve by passing through the spaces between the conveyor belts.

When the sleeve 21 is received, the jaw 10 closes on the front portion of the sleeve 21. The jaw can be actuated by mechanical or electrical means. In the case of mechanical action, the jaw assembly 2 may be constructed with a ball and spring arrangement which bear against the inside portion of the jaw 10 as disclosed in U.S. Pat. Nos. 4,819,926 and 4,784,381. The action of the blade 12 opens and closes the jaw 10 upon contact with, and then immediate retraction from, the jaw assembly 2. In the case of electrical action, the jaw assembly may be outfitted with a switch and motor which can be actuated by signals to open and close the jaw at the appropriate time.

The jaw 10 holds the front portion of the sleeve in a stationary position above the conveyor belt 4. The front blower 17 is actuated to assist in starting and maintaining a smooth rolling action of the sleeve 21 as it is carried under the jaw assembly 2 by the conveyor belt 4.

As shown in Stage C, the blade 12 has retracted, and the sleeve 21 is turned over and folded at the middle by the combined action of the front blower 17 and the conveyer belt 4 which continues to carry the remainder of the sleeve in the direction of the line of feed. As the sleeve 21 is turned inside out and folded, hem edges and stitches previously made in the sleeve 21 are also aligned.

After the trailing edge 23 of the sleeve 21 passes under the sensor 5 as shown in Stage D, the jaw opens and release the sleeve 21. In one embodiment, it is contemplated that a central processing unit could actuate the jaw assembly 2 and cause the jaw 10 to open upon receipt of a signal from the sensor 5.

At about the same time as the sleeve is released, the rear blower 19 is turned on to blow air in the direction of the jaw assembly 2. The blown air uncurls any tip and unfolds any unwanted folds in the sleeve 21, especially in the back portion. The air from the rear blower 19 also aligns the tip of the sleeve, thus completing the fold.

Figure 3:
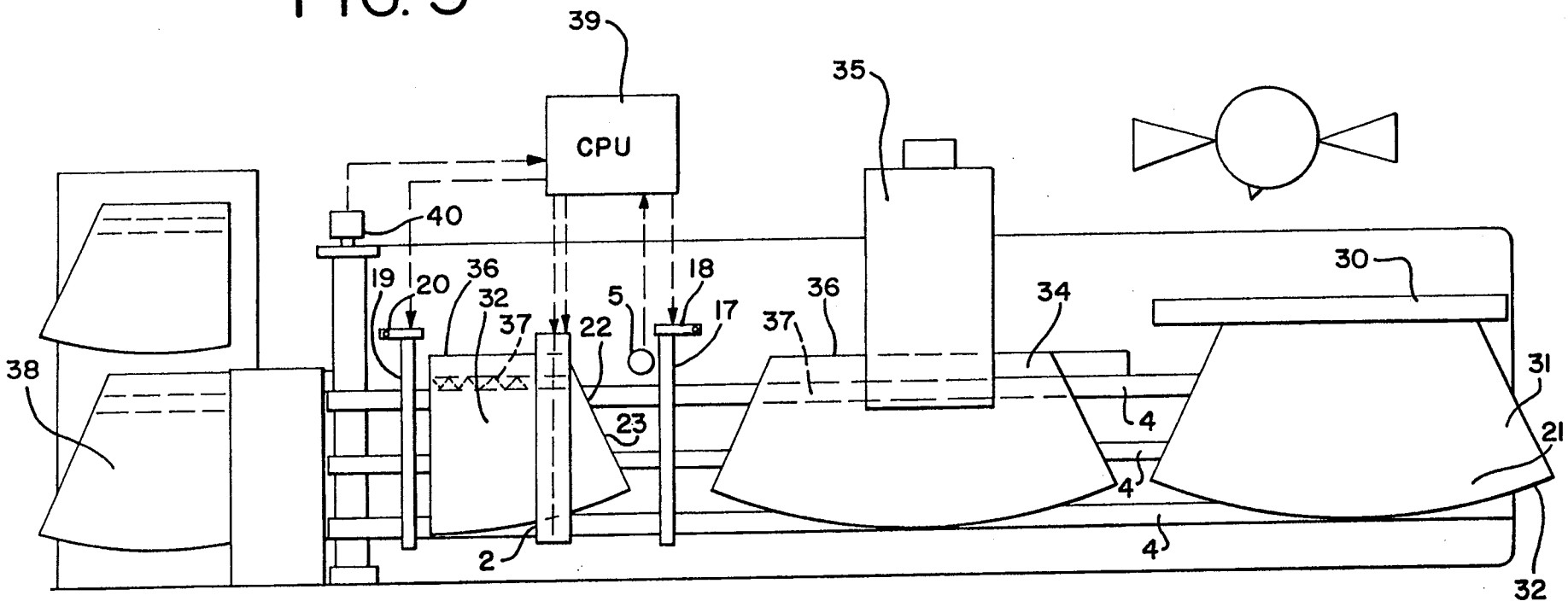
FIG. 3 illustrates a sleeve sewing operation employing a sleeve handling device.

FIG. 3 illustrates a particular use of the sleeve handling device in a sewing operation. Four basic stations are illustrated on a blank sleeve 21 having a top side 31 and a bottom side 32. At Station 1, an operator places a pre-cut blank sleeve piece 21 with the top side 31 facing up onto a set of moving conveyer belts 4 and aligns the sleeve with a bar 30. The conveyor belts 4 move the sleeve 21 into Station 2.

At Station 2, the edge of the sleeve 36 is trimmed and folded by hem folder 34, and a seam 37 is sewn by machine 35. The hem folder 34 and sewing machine 35 do not form a part of the present invention. Thus, these machines perform conventional operations such as trimming and folding followed by a two-needle cover stitch.

The hemmed and sewn sleeve 21 is then carried by conveyor belts 4 to Station 3 where the front portion of the sleeve 21 is picked up and the sleeve is turned over, aligned and folded by the present invention as previously described. After folding, the leading edge of the sleeve 22 is folded back onto and aligned with the trailing edge 23, and the bottom side 34 of the front half portion of the sleeve 21 is turned face up. In addition, the hem edges 36 and stitches 37 are aligned.

The turned over and folded sleeve 21 is then carried by the conveyor belts 4 to Station 4 where the sleeve is placed onto a stack 38 and is ready for an additional seaming or sewing operation.

Figure 4A:
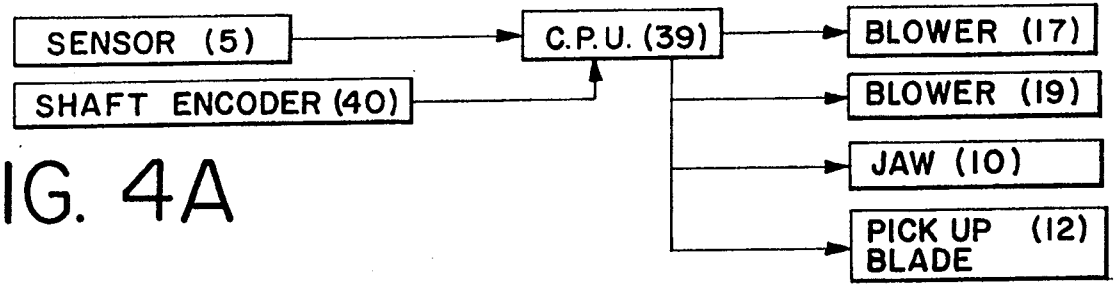
FIG. 4 illustrates a sleeve pick up and drop off control and timing scheme.
Figure 4B:
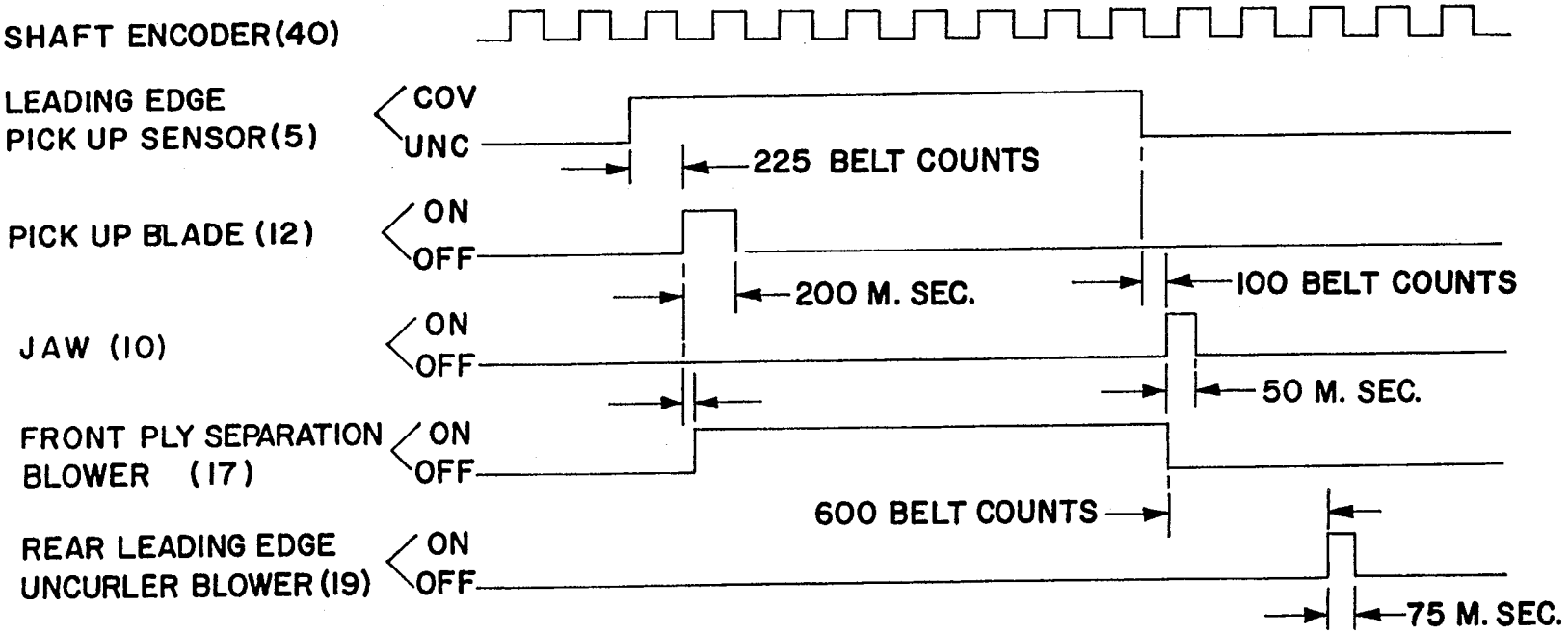

FIG. 4*a* illustrates a sleeve pick up and drop off timing and control scheme, where a central processing unit 39 receives and transmits signals between sensor 5, jaw 10, pick up blade 12, air blowers 17, 19 and shaft encoder 40 which are connected to electro-mechanical pneumatic solenoid valves. In this embodiment, the shaft encoder 40 is connected to a driven belt shaft or roller (not shown). The encoder 40 produces pulses, or belt counts, that are counted by the central processing unit 39. As shown in FIG. 4*b*, when the sensor 5 is first covered by the ply (indicated as COV), the pick up blade 12 is turned on and fires after 225 belt counts have elapsed. The pick up blade remains on for about 200 milliseconds (ms). The pick up blade carries the ply into the jaw and, in this embodiment, causes the jaw to open and grasp the ply as already described. A short time (less than 50 ms) after the pick up blade 12 is turned on the front ply separation blower 17 is turned on. 100 belt counts after the time that the sensor 5 is uncovered by the ply (indicated as UNC), the jaw 10 is turned on for 50 ms, thereby releasing the ply, and the front ply separation blower 17 is turned off. Finally, 600 belt counts after the front ply separation blower 17 is turned off the rear leading edge uncurler blower 19 is turned on for 75 ms.

The foregoing describes preferred embodiments of the invention and is not to be construed as a limitation of the invention which is set forth in the claims.

We claim:

1. A device for folding and turning over a cloth that is continuously carried by a moving conveyor, said device comprising:

a) a jaw located above the upper surface of the conveyor;

b) means for sensing an edge of the cloth;

c) a lifting blade located below the lower surface of the conveyor;

c) a first blower located before the jaw in the line of feed for the conveyor to assist in starting and maintaining a smooth rolling action of the cloth; and d) a second blower located after the jaw in the line of feed for the conveyor for uncurling the leading portion of the cloth.

2. A system for forming a workpiece that is carried by at least one moving conveyor, the system comprising:

a hem folder aligned adjacent to the conveyor;

a sewing machine located after the hem folder in a line of feed for the conveyor; and a folding and turning device located after the sewing machine in the line of feed for the conveyor, the folding and turning device having means for lifting a leading portion of the workpiece, a first means for blowing onto a top side of the workpiece to assist in starting and maintaining a smooth rolling action of the workpiece, and a second means for blowing onto a bottom side of the workpiece to uncurl the leading portion of the workpiece.

3. The system of claim 3 wherein the means for lifting the leading portion of the workpiece comprises a jaw located above the upper surface of the conveyor, a lifting blade in line with the jaw below the lower surface of the conveyor, and means for sensing the presence or absence of the workpiece.

4. The system of claim 3 wherein the lifting blade is responsive to a signal generated by the sensing means.

5. The system of claim 3 wherein the first and second blowing means are responsive to a signal generated by the sensing means.

6. The system of claim 3 wherein the sensing means transmits a signal to a central processing unit, the central processing unit generating signals that are transmitted to the jaw, the lifting blade, or the first and second blowing means.

7. The system of claim 2 wherein the first blowing means comprises a first blower located before the lifting means in the line of feed for the conveyor, the first blower having at least one nozzle directed toward the area below the lifting means.

8. The system of claim 7 wherein the second blowing means comprises a second blower located after the lifting means in the line of feed for the conveyor, the second blower having at least one nozzle directed toward the area below the lifting means.

9. The system of claim 8 further comprising means for sensing the workpiece, wherein the first and second blowers are responsive to a signal generated by the sensing means.

10. A system for automatically forming a workpiece comprising:

means for conveying the workpiece;

means for sewing along an edge of the workpiece as the workpiece is carried by the conveying means;

means for sensing the sewn workpiece as the sewn workpiece is carried by the conveying means; and means for folding and turning over the sewn workpiece including means for lifting a leading portion of the workpiece, a first means for blowing onto a top side of the workpiece to assist in starting and maintaining a smooth rolling action of the workpiece, and a second means for blowing the workpiece for uncurling the leading portion of the workpiece, the folding means being operable in response to the sensing means.

11. The system of claim 10, further comprising a second means for folding along the first edge of the workpiece.

12. The system of claim 10 wherein the folding means comprises a workpiece holding means located above the upper surface of the conveyer.

13. The system of claim 10 wherein the folding means comprises a workpiece lifting means located below the lower surface of the conveyer.

14. The system of claim 10 wherein the folding means comprises a pincer attached to an arm located above the conveying means.

15. The system of claim 10 wherein the folding means comprises pneumatic means located above the conveying means.

16. The system of claim 10 further comprising means for sewing a seam in the workpiece, the sewing means located after the folding means in a line of feed for the conveying means.

17. A method for forming a shirt sleeve from a sleeve blank comprising:

conveying the sleeve blank;

forming a hem along a first edge of the conveyed sleeve blank;

folding and turning over the hemmed sleeve blank as the sleeve blank is conveyed by lifting a leading portion of the sleeve blank, blowing air onto a top side of the sleeve blank to assist in starting and maintaining a smooth rolling action of the sleeve blank, releasing the leading portion of the sleeve blank, and blowing air onto a bottom side of the sleeve blank to uncurl the leading portion of the sleeve blank; and sewing an overlapped portion of the folded sleeve blank along a second edge to form a shirt sleeve.

18. A method for forming a workpiece comprising:

conveying the workpiece;

forming a hem along an edge of the workpiece as the workpiece is conveyed; and folding and turning over the hemmed workpiece by lifting a leading portion of the workpiece, blowing air onto a top side of the workpiece, releasing the leading portion of the workpiece, and blowing air onto a bottom side of the workpiece to uncurl the leading portion of the workpiece.

* * * * *

UNITED STATES PATENT AND TRADEMARK OFFICE

CERTIFICATE OF CORRECTION

PATENT NO. : 5,363,784

DATED : November 15, 1994

INVENTOR(S) : Maximilian Adamski, Jr.

It is certified that error appears in the above-indentified patent and that said Letters Patent is hereby corrected as shown below:

Col. 3,
In claim 3, line 1, delete "3" and substitute --2--.

Signed and Sealed this

Twenty-sixth Day of September, 1995

*Attest:*

Bruce Lehman

BRUCE LEHMAN

*Attesting Officer*

*Commissioner of Patents and Trademarks*